US008636161B2

(12) United States Patent
Dunwoody

(10) Patent No.: US 8,636,161 B2
(45) Date of Patent: Jan. 28, 2014

(54) CLOSURE

(75) Inventor: Paul Robert Dunwoody, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 356 days.

(21) Appl. No.: 12/922,989

(22) PCT Filed: Feb. 12, 2009

(86) PCT No.: PCT/EP2009/051630

§ 371 (c)(1),
(2), (4) Date: Sep. 16, 2010

(87) PCT Pub. No.: WO2009/115377

PCT Pub. Date: Sep. 24, 2009

(65) Prior Publication Data

US 2011/0011866 A1 Jan. 20, 2011

(30) Foreign Application Priority Data

Mar. 20, 2008 (EP) ..... 08153134
Jun. 10, 2008 (GB) ..... 0810511.6

(51) Int. Cl.

| | |
|---|---|
| ***B65D 41/00*** | (2006.01) |
| ***B65D 41/04*** | (2006.01) |
| ***B65D 45/00*** | (2006.01) |
| ***B65D 45/32*** | (2006.01) |

(52) U.S. Cl.

USPC ..... 215/274; 215/273; 215/276; 215/324; 215/329; 220/309.1; 220/309.2; 220/310.1; 220/319

(58) Field of Classification Search

USPC ..... 220/309.1, 309.2, 310.1, 319, 376; 215/273, 274, 275, 276, 304, 324, 329

See application file for complete search history.

(56) References Cited

U.S. PATENT DOCUMENTS

| | | | | |
|---|---|---|---|---|
| 470,529 | A * | 3/1892 | Williams | 220/810 |
| 1,349,837 | A | 8/1920 | Johnson | |
| 1,699,069 | A | 1/1929 | Huntar | |
| 2,139,682 | A | 12/1938 | Hothersall | |
| 2,166,923 | A | 7/1939 | Woodcock | |
| 2,216,082 | A | 9/1940 | Kronquest et al. | |
| 2,522,301 | A | 9/1950 | Rooney | |

(Continued)

FOREIGN PATENT DOCUMENTS

| | | |
|---|---|---|
| DE | 2933547 | 3/1981 |
| DE | 3619322 | 12/1986 |

(Continued)

OTHER PUBLICATIONS

U.S. Appl. No. 12/988,933, filed Apr. 6, 2009, Dunwoody et al.

(Continued)

*Primary Examiner* — Anthony Stashick
*Assistant Examiner* — Madison L Poos
(74) *Attorney, Agent, or Firm* — Woodcock Washburn LLP

(57) ABSTRACT

A two-part closure (1) which has a disc (2) and a skirt (3). In one example, the skirt wall is smooth between upper and lower rims so that the disc is moveable between the rim features. Typically in a metal skirt or ring, the upper rim feature is a curl (11) and the lower rim feature is a curled edge (12) with equi-spaced lugs (13) on the skirt wall.

21 Claims, 12 Drawing Sheets

(56) References Cited

U.S. PATENT DOCUMENTS

| | | | | |
|---|---|---|---|---|
| 2,527,885 | A | | 10/1950 | Krueger |
| 2,621,622 | A | | 12/1952 | Henchert |
| 2,702,597 | A | | 2/1955 | Wickwire et al. |
| 2,975,740 | A | | 3/1961 | Smith et al. |
| 2,991,602 | A | | 7/1961 | Van De Kerke et al. |
| D192,757 | S | | 5/1962 | Foss et al. |
| 3,068,344 | A | | 12/1962 | Keinanen et al. |
| 3,124,872 | A | | 3/1964 | Knodel |
| 3,157,080 | A | | 11/1964 | Hanni |
| 3,186,003 | A | | 5/1965 | Gregory, Jr. et al. |
| 3,380,419 | A | | 4/1968 | Moloney |
| 3,446,381 | A | | 5/1969 | Podesta et al. |
| 3,581,691 | A | | 6/1971 | Ringler |
| 3,802,362 | A | | 4/1974 | Daniel et al. |
| 3,813,972 | A | | 6/1974 | Van Alsburg |
| 3,836,033 | A | | 9/1974 | Podesta |
| D240,595 | S | | 7/1976 | Kress |
| 4,003,324 | A | | 1/1977 | Tate et al. |
| 4,004,478 | A | | 1/1977 | Morgan |
| D244,065 | S | | 4/1977 | Daenen |
| 4,022,141 | A | | 5/1977 | Bartenstein |
| 4,030,432 | A | | 6/1977 | Miller et al. |
| 4,111,330 | A | * | 9/1978 | Jordan ..... 220/319 |
| RE30,746 | E | | 9/1981 | Stroobants et al. |
| 4,299,147 | A | | 11/1981 | Rogers |
| D266,906 | S | | 11/1982 | Guerette |
| 4,473,163 | A | | 9/1984 | Geiger |
| 4,487,539 | A | | 12/1984 | Taylor et al. |
| 4,762,579 | A | | 8/1988 | Shimizu et al. |
| 4,808,053 | A | | 2/1989 | Nagai et al. |
| 4,942,777 | A | | 7/1990 | Fife |
| 5,014,491 | A | | 5/1991 | Tsukada et al. |
| 5,078,564 | A | | 1/1992 | Zago |
| 5,325,696 | A | | 7/1994 | Jentzsch et al. |
| 5,782,599 | A | | 7/1998 | Moran et al. |
| 5,785,198 | A | * | 7/1998 | Credle, Jr. ..... 220/254.8 |
| 5,839,869 | A | | 11/1998 | Moran et al. |
| D480,304 | S | | 10/2003 | Stodd |
| 6,662,958 | B2 | | 12/2003 | German et al. |
| D489,005 | S | | 4/2004 | Miceli et al. |
| D522,364 | S | | 6/2006 | Hicks et al. |
| D526,740 | S | | 8/2006 | Xu |
| D536,975 | S | | 2/2007 | Smith et al. |
| 7,461,576 | B2 | | 12/2008 | Dickey |
| D612,196 | S | | 3/2010 | Furlong |
| 7,731,048 | B2 | | 6/2010 | Alvares et al. |
| D628,894 | S | | 12/2010 | Pontes |
| 8,393,192 | B2 | | 3/2013 | McEldowney et al. |
| 2004/0016758 | A1 | | 1/2004 | Richardson |
| 2007/0090111 | A1 | | 4/2007 | Alvares et al. |
| 2010/0003109 | A1 | | 1/2010 | Ramsey et al. |

FOREIGN PATENT DOCUMENTS

| | | |
|---|---|---|
| EP | 0092884 | 11/1983 |
| EP | 0599549 | 6/1994 |
| EP | 1686070 | 8/2006 |
| EP | 1918041 | 5/2008 |
| FR | 620920 | 5/1927 |
| FR | 769264 | 8/1934 |
| FR | 2177118 | 11/1973 |
| WO | WO 95/11104 | 4/1995 |
| WO | WO 2005/063587 | 7/2005 |
| WO | WO 2008/053014 | 5/2008 |
| WO | WO 2009/060291 | 5/2009 |
| WO | WO 2009/115377 | 9/2009 |
| WO | WO 2009/130122 | 10/2009 |

OTHER PUBLICATIONS

U.S. Appl. No. 29/361,421, filed May 11, 2010, Dunwoody et al.
U.S. Appl. No. 29/361,422, filed May 11, 2010, Dunwoody et al.
U.S. Appl. No. 29/361,424, filed May 11, 2010, Dunwoody et al.
U.S. Appl. No. 29/361,437, filed May 11, 2010, Dunwoody et al.
U.S. Appl. No. 29/361,441, filed May 11, 2010, Dunwoody et al.
U.S. Appl. No. 29/361,443, filed May 11, 2010, Dunwoody et al.
U.S. Appl. No. 29/361,446, filed May 11, 2010, Dunwoody et al.
U.S. Appl. No. 29/361,448, filed May 11, 2010, Dunwoody et al.
U.S. Appl. No. 29/361,449, filed May 11, 2010, Dunwoody et al.
U.S. Appl. No. 29/382,735, filed Jan. 6, 2011, Dunwoody.
U.S. Appl. No. 29/382,739, filed Jan. 6, 2011, Dunwoody.
U.S. Appl. No. 29/382,732, filed Jan. 6, 2011, Dunwoody.
U.S. Appl. No. 29/382,738, filed Jan. 6, 2011, Dunwoody.
U.S. Appl. No. 29/382,744, filed Jan. 6, 2011, Dunwoody.

* cited by examiner

CLOSURE

CROSS-REFERENCE TO RELATED APPLICATIONS

This application is the National Stage of International Application No. PCT/EP2009/051630 filed Feb. 12, 2009, which claims the benefit of EP application number 08153134.5, filed Mar. 20, 2008, and GB application number 0810511.6, filed Jun. 10, 2008, the disclosures of which are incorporated herein by reference in their entirety.

TECHNICAL FIELD

This invention relates to a closure. In particular, it relates to the combination of a closure and a container, the container typically including threads. The closure is of the two-part type of closure, which comprises an inner cap or disc part, and a ring or skirt part.

BACKGROUND ART

Two-part closures typically comprise a cap or disc which is held onto a container by a skirt, which is sometimes referred to as a ring, or overcap. The two parts may be of the same material, or different materials as in a combination closure or "combo-cap" which uses a metal disc and a plastic skirt. The skirt often defines threads or lugs, which cooperate with complementary features on a container neck. Sealing material is conventionally applied to the disc to form a seal between the disc and the mouth of the container.

There are many examples of two-part closures, of which U.S. Pat. No. 3,446,381 A (PODESTA ET AL) is one of the older examples. That patent describes a two-part metallic cap with a separate disc and "sleeve-like" skirt. Another two-piece metallic cap from the same inventor is shown in U.S. Pat. No. 3,836,033 A (PODESTA). In U.S. Pat. No. 3,836,033 A the disc has an edge portion which projects beyond the container mouth, an annular portion which sits on the top edge of the container mouth and a middle portion covering the opening of the container. The entire middle portion of the disc moves between concave and convex configurations by pivoting of the annular portion about the top edge of the container mouth. Both of these closures can be used for containers such as glass bottles, pots and the like.

It has also been popular to provide screw threads or lugs on the skirt, whether this is of metal or of plastics material. For example, the skirt may be part of a threaded outer cap, as in U.S. Pat. No. 4,473,163 B (ERNST & CO.) in which the outer cap prises the inner cap off the container during unscrewing. This is particularly useful when the closure is used for the packaging of food products, which during processing "pull" a negative pressure, often called a "vacuum". This vacuum creates a substantial resistance to opening. The two-piece cap of EP 1686070 A (PLATO PRODUCT CONSULTANTS V.O.F.) has a special feature to reduce torque on opening. This feature is similar to a dimple, which during opening, pushes up a disc-shaped inner cap to overcome the forces between jar and closure, which create the sealing of the package.

The 2-piece closure design allows the breaking of the container seal to be controlled. The initial twisting of the skirt is sometimes used to activate a tamper-evident feature, such as breaking a tamper-evident band, whilst the disc remains sealed to the container. Thereafter, a further feature may be provided on the skirt to prise the disc from the container, thereby breaking the seal between the disc and the container to equalise any difference between the internal pressure in the container and the external environment. This 2-stage opening reduces the torque required to open the closure and allows the closure to be removed more easily.

Although known features such as these can reduce the force necessary to break vacuum, there are still problems inherent in the combined opening force requirements of unscrewing and breaking the vacuum. This invention seeks to overcome those problems.

DISCLOSURE OF INVENTION

According to the present invention, there is provided a two-part closure comprising a disc and a skirt, in which the disc has a seal and a surrounding rim and is held moveably between an inwardly projecting rim at the upper end of the skirt and an annular inward projection on the skirt wall and/or lugs at the lower end of the skirt wall, the closure being adapted for use with a container and the sum of the distance (B) between the seal and the contact point of the disc rim and lower skirt rim, plus the effective thickness (A) of the lugs is greater than the distance (C) between the top of threads on the container and the top of the container.

The term "disc" is used to define the whole of an inner cap component and is not intended to infer that that component is simply a thin circular component. Preferably, the centre portion of the disc is a substantially flat planar panel and radially outwardly of this panel the disc is profiled for sealing a container to which the closure is attached, as discussed in more detail below.

It is thus possible to manufacture the closure of the invention from fairly stiff material, for example from a single piece of metal (e.g. steel) and as described in WO/2008/053014. In any event, the closure disc is not intended to be overly flexible or moveable from concave to convex and returning to concave as is required in U.S. Pat. No. 3,836,033 A, which is equivalent to FR 2177118.

The effective thickness of the lugs is the axial distance (A) between a position (X), which is the contact point between the lug and the top of the container thread, and a position (Y), which is the contact point of disc rim and skirt rim. The references refer to FIGS. 9 and 10 of this application. Clearly the invention is only applicable to closures, which have a skirt depth that is more than that of a simple overcap or lid.

The container, which the closure of the invention is suitable to close may be a jar or bottle (of glass or plastics material) or even a metal can. Although a usual use for the closure of the invention would be with a glass jar, the expressions are used interchangeably in this application. The jar generally includes threads but one or more waves, cams or projections may be used in the place of threads. A single continuous thread, as in a rolled-on thread, may also be provided on the jar.

During opening of the closure of the invention, the first stage of torque application to rotate the skirt and release the lug from the underside of the thread is distinctly separate from the second stage which is needed to prise the disc axially away from the container by forcing the lugs between the top of the threads and the underside of the disc rim. There is thus no effort required to slide the seal of the disc part relative to the top of the jar and the disc may audibly jump when the seal is broken on first opening.

The strength of the lugs required to prise the disc from the jar during opening is less than that required for lugs on a conventional twist closure as the lugs of the present invention only have to resist crushing between the thread and the disc and do not have to resist bending. Thinner material may thus be used to form the skirt. Although the disc is typically of metal for optimum barrier properties, for example, the skirt may be a plastics material or metal.

The most preferred embodiment of the invention is an all-metal closure. Of course, if both parts of the closure were made from the same piece of metal, this would result in cost saving, environmental and resources conservation, even if the panels and rings were mixed and matched from the metal sheets or discs from which they were formed. Also, the metal could be decorated, and decoration of skirt (ring) and disc matched for aesthetic purposes for example.

Where the closure is of metal, this is preferably steel. The thickness of steel may be less than that used for the manufacture of vacuum twist closures. Thus the steel used for the closures of the present invention may be less than 0.14 mm for closures of 48 mm nominal diameter and below, less than 0.15 mm for closures of 48 mm nominal diameter and below, less than 0.16 mm for closures of 66 mm nominal diameter and below, less than 0.17 mm for closures of 77 mm nominal diameter and below, less than 0.18 mm for closures of 82 mm nominal diameter and below, and less than 0.20 mm for closures of 110 mm nominal diameter and below. The metal may be a polymer-coated metal.

Generally, the inwardly projecting rim on the top of a metal skirt is curled inwardly to hide the upper cut edge. Not only does this enhance the appearance of the skirt, but it also provides a safe edge. The lower end of the skirt is also usually curled inwardly to obscure the lower cut edge of the skirt and to provide a smooth surface against which to push the rim of the disc part during opening. The rim of a metal disc part is usually curled (inwardly or outwardly) to obscure the cut edge of the disc and the disc part may be sealed or even filled with compound or sealing material. Cut edge protection may be enhanced by conventional processes such as by the use of roller-coated lacquers. Of course it is possible for all cut edges to be coated after cutting.

The radius of curvature of any of the curled regions, either on skirt or disc, is typically no less than 0.4 mm This gives a good appearance and smooth feel, and avoids damage to decoration or protective coatings, which could occur if the curl is too tight, for example.

The inwardly projecting rim on the top end of the skirt part may be discontinuous so that inwardly projecting rim portions are only provided where there is no lug opposite. This simplifies manufacture of the ring, particularly if the ring is made from plastic because ejection from the mould is simpler and insertion of the disc into a more flexible ring is easier.

In one embodiment, the height of the disc rim may vary around its circumference. Another alternative is for the height or thickness of the skirt lugs or adjacent curled regions to vary. In yet another embodiment, the height or thickness of the top of the container threads may vary. Any of these alternatives have the advantage that during the second stage of opening, the force to prise the disc from the top of the container is focussed at one part of the circumference, and so less torque is required.

Either or both of the surfaces of the disc and skirt, which contact one another when the container is closed, may undulate or include protrusions/dimples to provide a gap or gaps between the skirt and disc. This reduces the area, which might stick during handling and any gap or gaps provide ventilation between the skirt and disc. Spaces between skirt, disc and container dry more effectively in these closures after filling and closing a container. Furthermore, accidental movement of the skirt may be avoided and evidence of movement such as opening may be provided. Flexibility of the panel and/or ring allows release of stuck surfaces either individually (disc/ring) or when assembled into closures. Addition of solid or liquid slip material or non-stick coatings may limit application torque and minimise sticking.

For tamper evidence or to avoid accidental movement of the ring, the skirt may be joined to the disc by a breakable material or strap.

When the closure is used to close a container, the top of the skirt in one embodiment is typically a little higher than the top of the disc before the closure is tightened onto the jar, and may flex slightly in combination with the disc to become substantially level when the desired tightness is achieved. Overtightening of the closure in so-called "top-belt driven cappers" may thus be avoided.

Although the closure of the invention does not require the entire middle portion of the disc to move between concave and convex as described in U.S. Pat. No. 3,836,033, it is common for the middle portion of closures of different types to have a small central bi-stable part or "button" which moves when internal vacuum is released and vice versa. This vacuum button feature may be included in the disc of our invention but it plays no part in any pivoting or in the sealing of the container itself.

BRIEF DESCRIPTION OF FIGURES IN THE DRAWINGS

Preferred embodiments of the invention will now be described, by way of example only, with reference to the drawings, in which.

Figure 2:
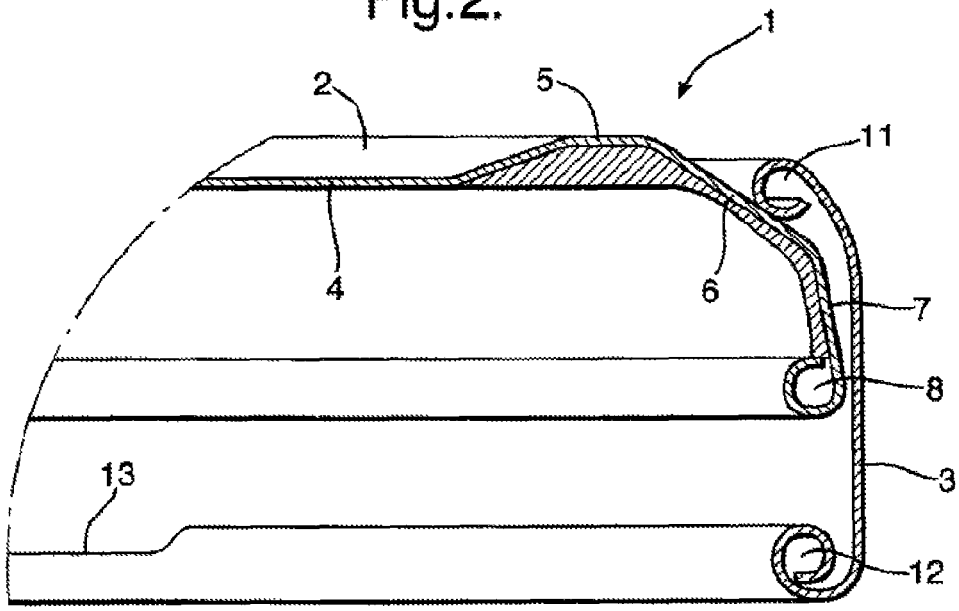
FIG. 2 is a partial side section through a curl of a closure with plain wall.
Figure 3:
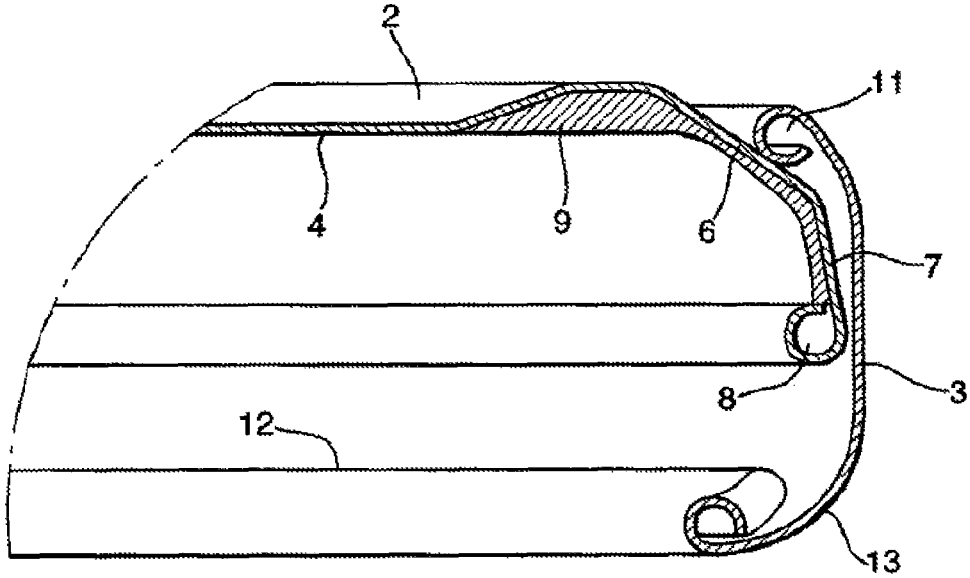
FIG. 3 is a partial side section through a lug of the closure of FIG. 2.
Figure 10:
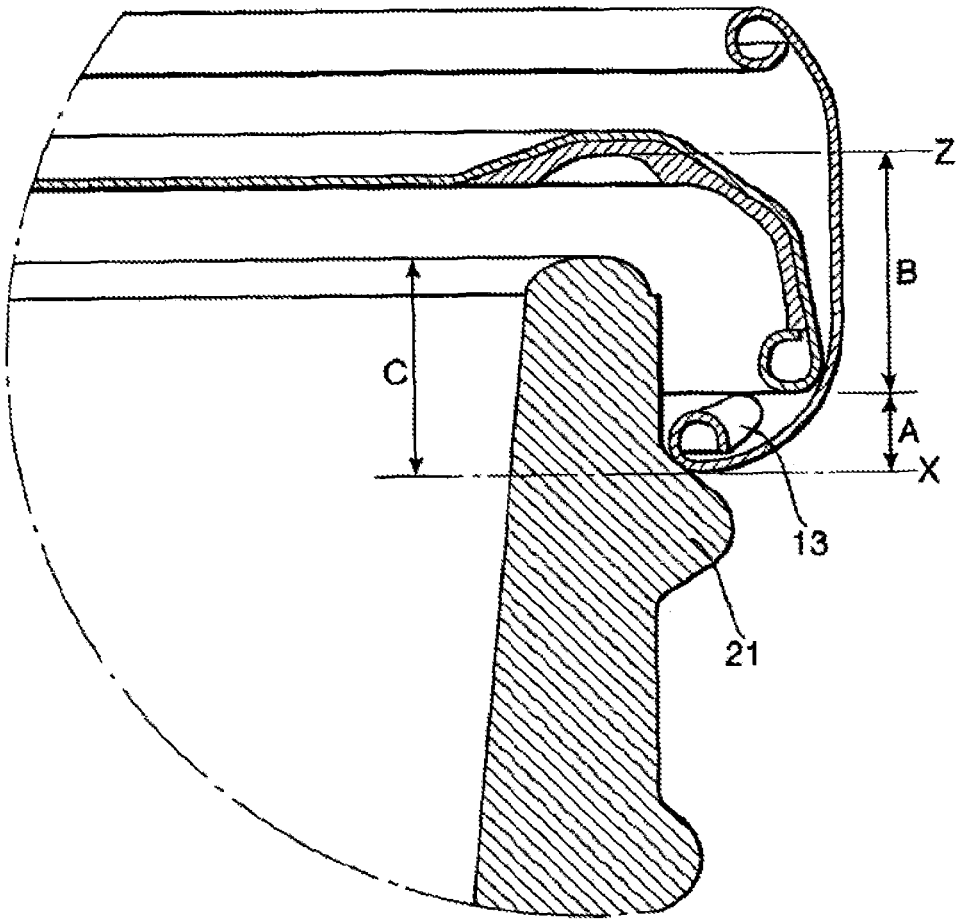
Figure 11:
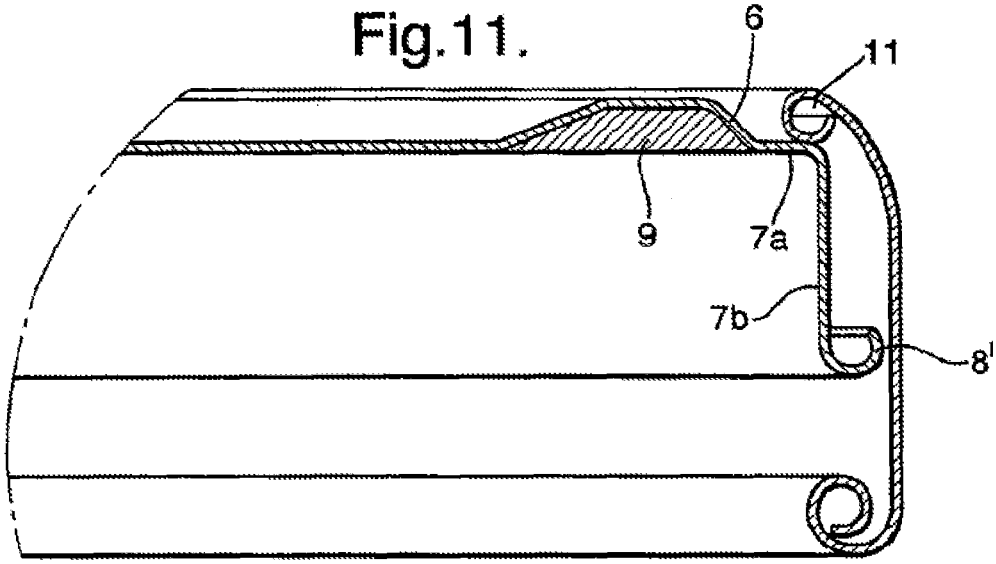
Figure 12:
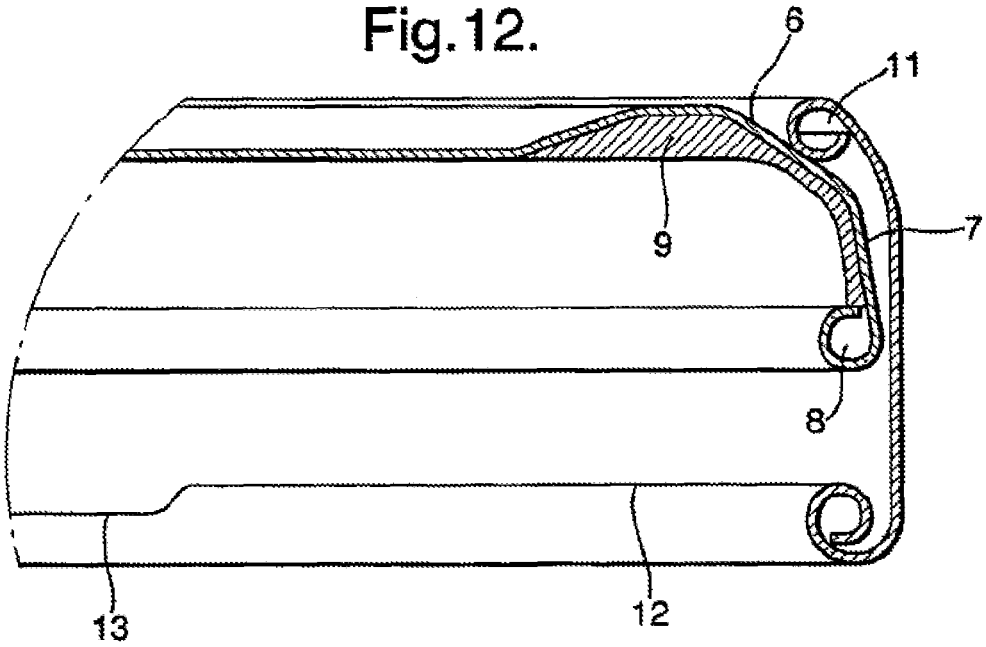
Figure 13:
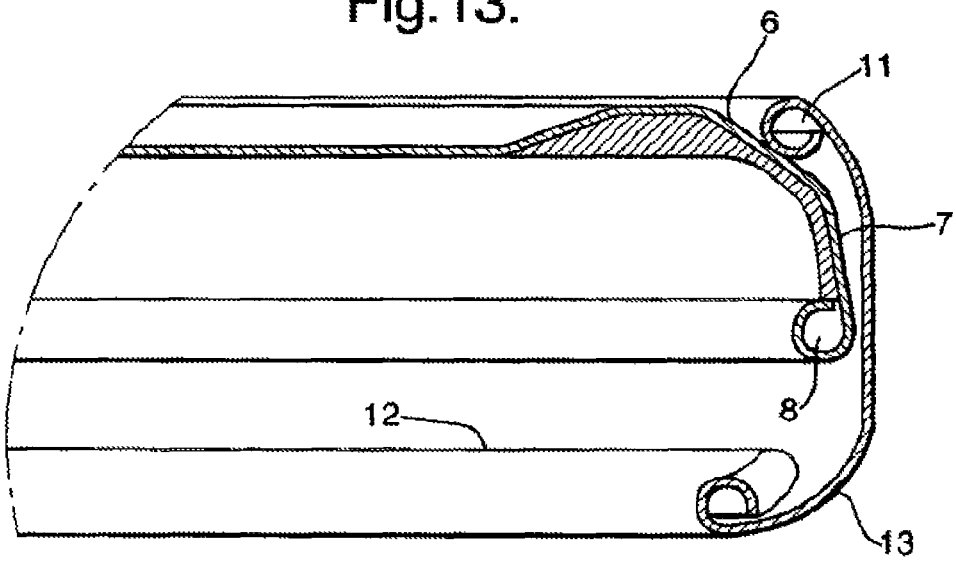
Figure 14A:
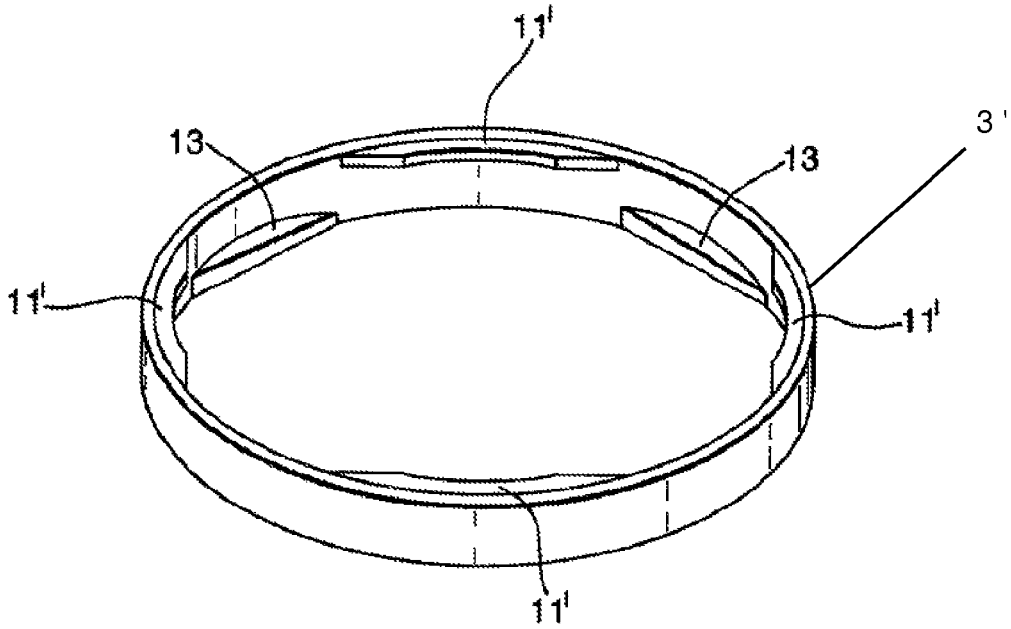
Figure 14B:
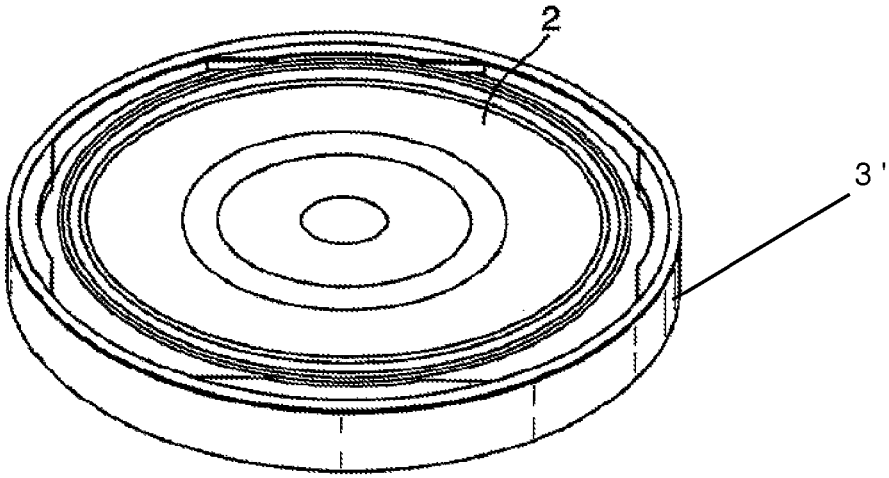
Figure 15:
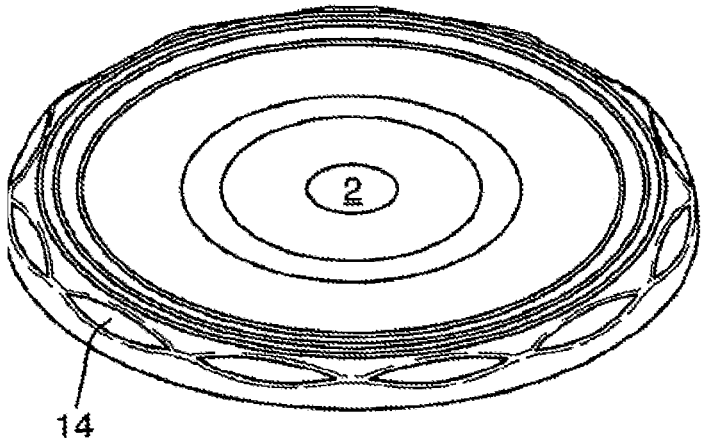

FIG. 10 a partial side section through a lug of the closure of FIGS. 2 and 3, above a jar after opening;

FIG. 11 is a partial side section through a curl of a closure with an outward curl on the disc;

FIG. 12 is a partial side section through a curl of a closure, with the top of the ring above the disc;

FIG. 13 is a partial side section through a lug of the closure of FIG. 12;

FIGS. 14*a* and 14*b* are perspective views of a closure ring and closure with four inwardly projecting rim portions opposite gaps between lugs;

FIG. 15 is a perspective view of a disc having "flats"; and

Figure 16:
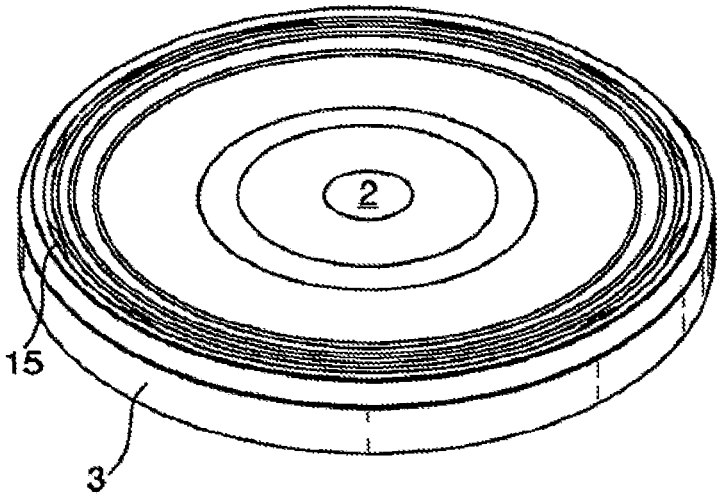

FIG. 16 is a perspective view of the disc of FIG. 15, fitted in a ring.

MODE(S) FOR CARRYING OUT THE INVENTION

Figure 1A:
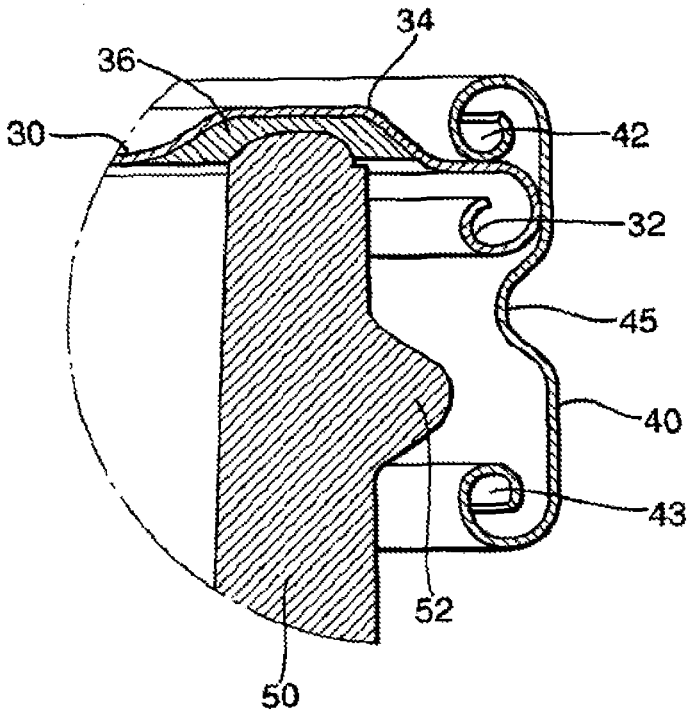
FIGS. 1A and 1B are partial side sections of an all-metal closure with an annular projection on skirt wall.
Figure 1B:
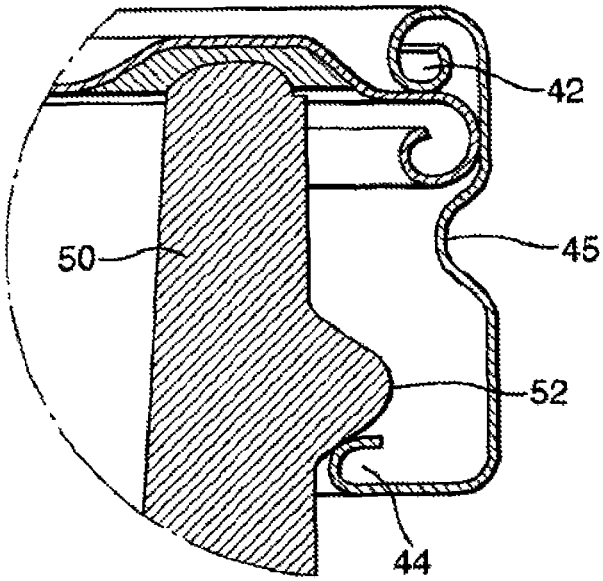

FIGS. 1A and 1B are side sections of a two-part closure manufactured for example in accordance with unpublished patent application PCT/EP2007/061744. Alternatively, the ring could be manufactured separately by techniques such as welding (e.g. laser welding), extrusion, or by using tubing. This of course means that the ring is not necessarily formed from metal, although this is the preferred material for closures of this invention. The closure comprises a metal disc 30, having its cut edge protected by a curl 32, and a circumferential ring 40. The disc 30 is trapped within the ring 40 by two curls 42, 43 at the opposed axial ends of the ring. FIG. 1A is a section through a curl 43 and FIG. 1B is a section through a lug 44.

A retention feature, or features 45 is/are provided to position the disc 30 loosely within the ring 40, whilst allowing the disc 30 freedom to move rotationally relative to the ring 40 and limiting axial movement. The retention feature 45 may take the form of spaced projections around the circumference of the ring 40, or alternatively may be provided by a circumferential bead, either full or segmented. A channel 34 is provided about the inside periphery of the disc 30, surrounding a flat centre panel, and this channel is used to hold sealing material 36. The provision of the channel 34 ensures proper location of the sealing material to interface with the neck of a container 50 and also reduces the quantity of sealing material 36 because of its better and more accurate distribution. A portion of thread 52 is also shown in FIGS. 1A and 1B. For opening, unscrewing of the closure causes lugs 44 to move over threads 52, causing retention feature 45 to push upwards against disc curl 32, thereby raising the disc 30 from the container 50.

FIGS. 2 and 3 show an all-metal two-part closure 1 having a disc part 2 and a skirt or ring part 3. Disc 2 has a flat central panel 4, surrounded by upwardly extending groove 5, shoulder 6, annulus 7 and terminating in inward curl 8. The groove 5 is profiled so as to retain sealing material or other material 9, in this example from the edge of planar central panel 4 to the curl 8.

Figure 4:
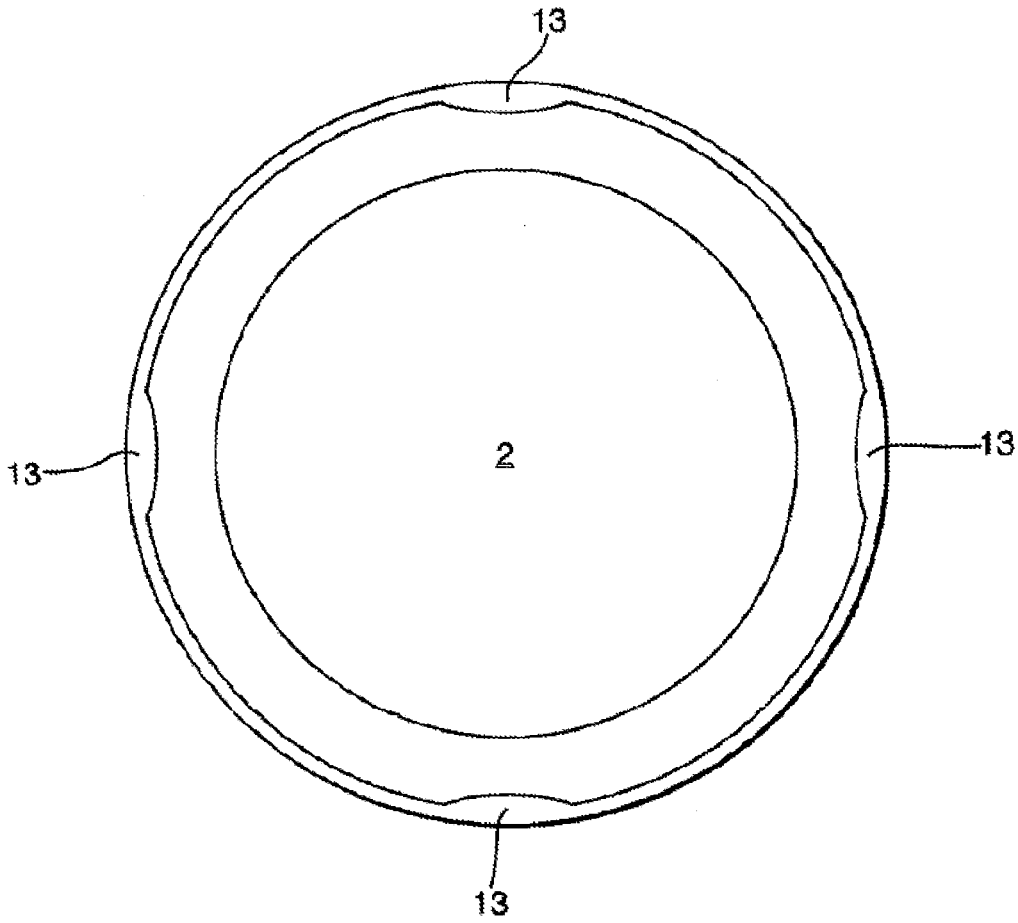
FIG. 4 is an underplan view showing four lugs.

The skirt 3 of FIGS. 2 and 3 has inward curls 11 and 12 at both upper and lower ends and lugs 13 (typically four, equispaced) around the lower edge. The lugs 13 are shown most clearly in the underplan view of FIG. 4. The top of the skirt (ring) in FIGS. 2 and 3 is below the level of the top of the channel 5, so that this embodiment is sometimes referred to as "ring below disc" or "disc over ring".

This ring below disc configuration has a smooth feel. When the closure is used to close a filled container, there is less risk of scuffing of the ring. For these reasons, this is the most preferred format for the invention. An alternative ring below disc closure may have the disc panel extending outside the top curl of the ring.

When the container is a glass jar which is closed by the ring below disc closure, it is well suited for stacking. The top of the closure may nest with a stacking bead around the bottom rim of the jar above.

In its form independently of any container, the disc 2 is free to move between a lower position when the curl on the disc abuts curl 12 and/or lug 13, and an upper position, as shown, when the disc abuts curl 11. The shoulder 6 of the disc of FIGS. 2 and 3 contacts upper curl 11. Sealing material 9 could of course be contained more locally by shaping the disc.

Figure 5:
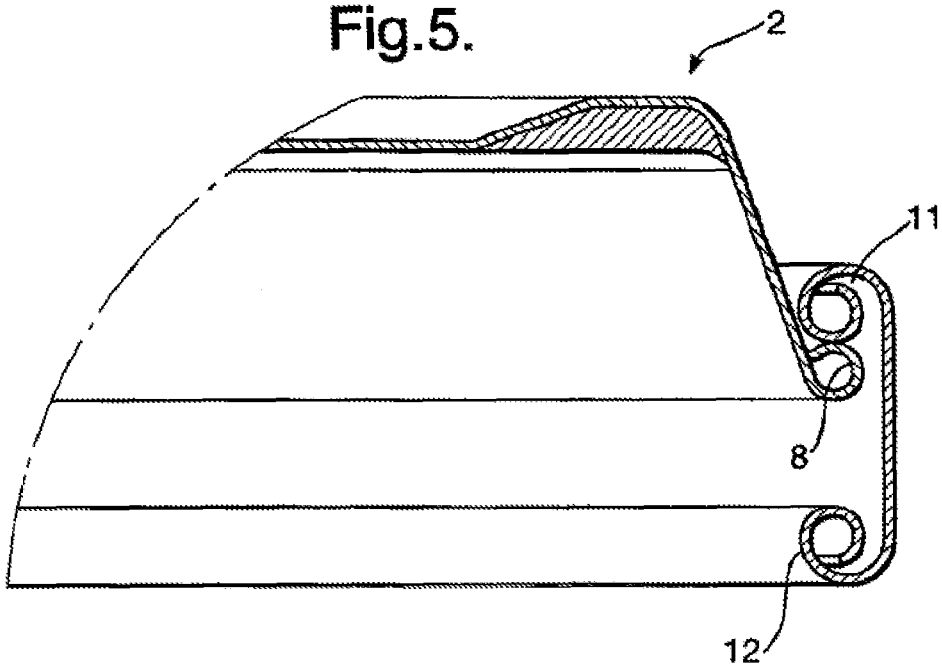
FIG. 5 is a partial side section through a curl of an alternative closure with an outward disc curl.
Figure 6:
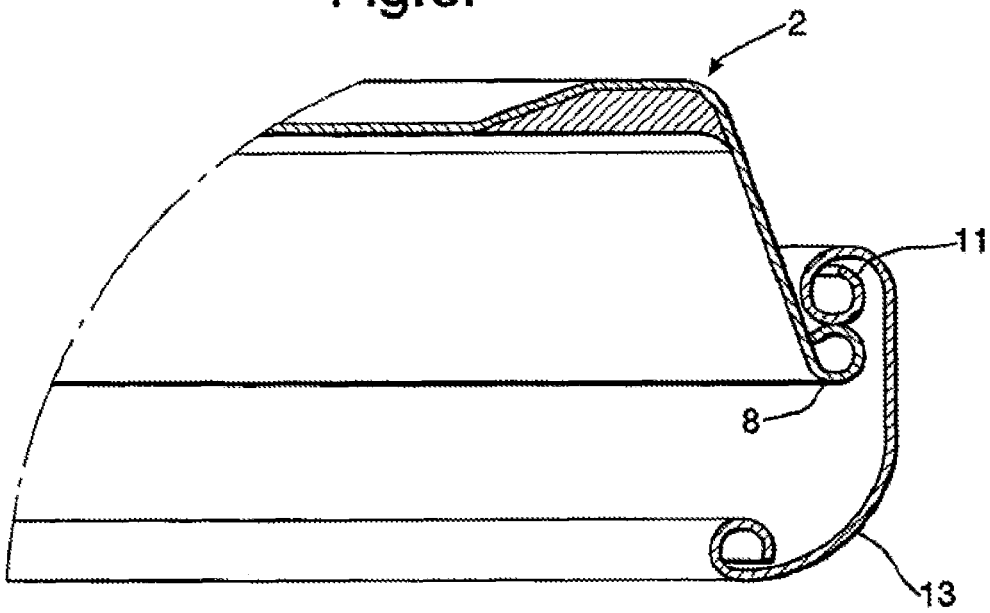
FIG. 6 is the partial side section of FIG. 5 through a lug of the closure.

Either curl may be inward or outward (reversed), with the ring above or below the panel. The curls may be partly or fully closed, rest on or in features of the disc 2 or ring 3, or other possible variants. In one arrangement, as shown in FIGS. 5 and 6, the disc curl 8 may be outward and the top curl 11 may be inward, such that the surface of the ring curl 11 that was originally on one side (preferably the decorated side) of the metal sheet contacts the surface of the disc curl 8 that was originally on the other side of the metal sheet. In this arrangement the contacting surfaces may have different coatings or one may not be coated at all, in order to avoid similar coatings sticking to one another, and the possibly undecorated surface of the outside of the disc curl 8 may be hidden from view when looking from the outside of the closure. FIG. 5 shows the inward top curl 11 resting on the outward disc curl 8 at a section through the lower curl 12 and FIG. 6 shows the same closure at a section through the lower lug 13.

Many features of the closures become more clear when closures are used to close a container. Although any screw container could be closed by any closure according to the invention, the drawings of FIGS. 7 to 10 show a glass jar, which has very distinct threads.

Figure 7:
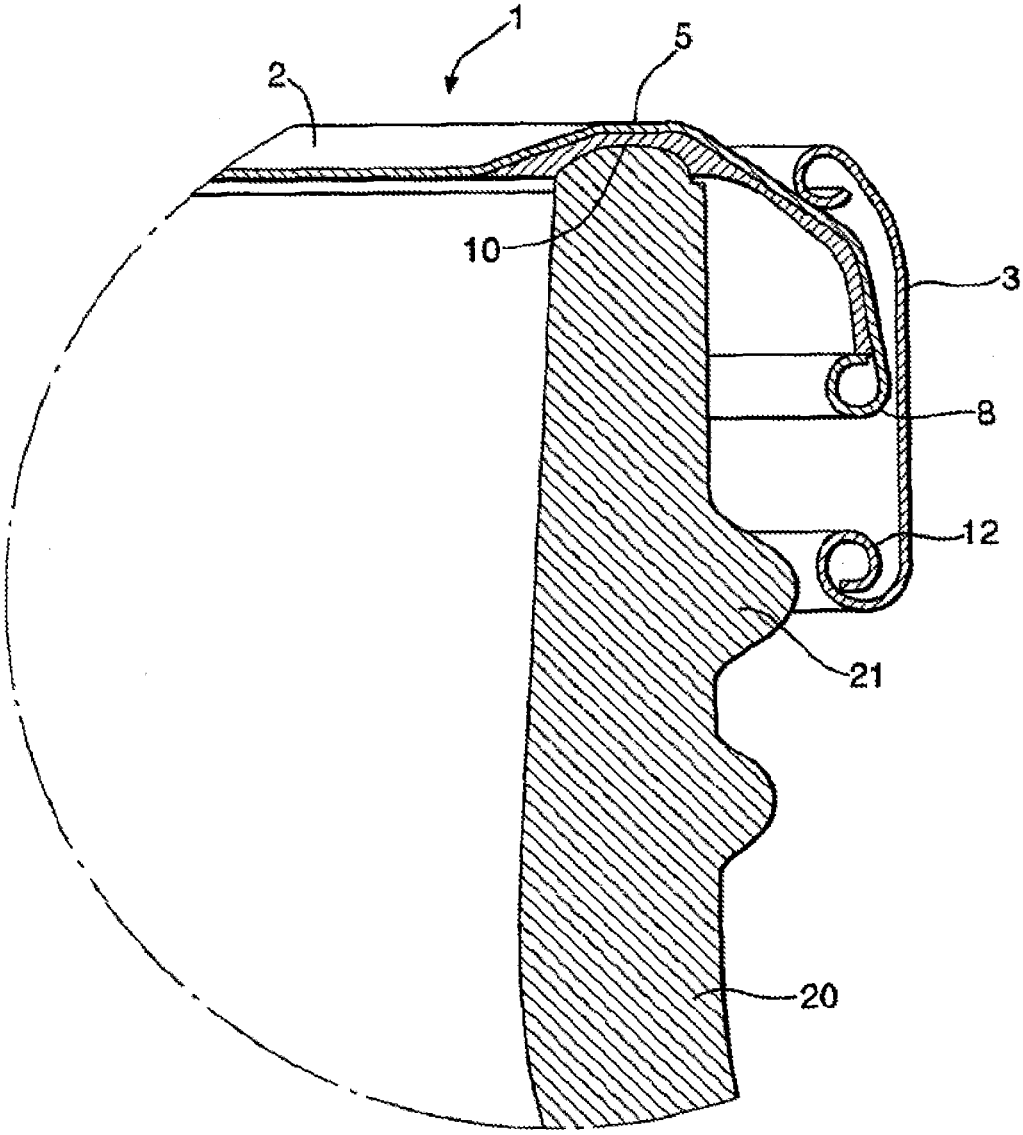
FIG. 7 is a partial side section through the curl of the closure of FIGS. 2 and 3 in closed position on a jar.
Figure 8:
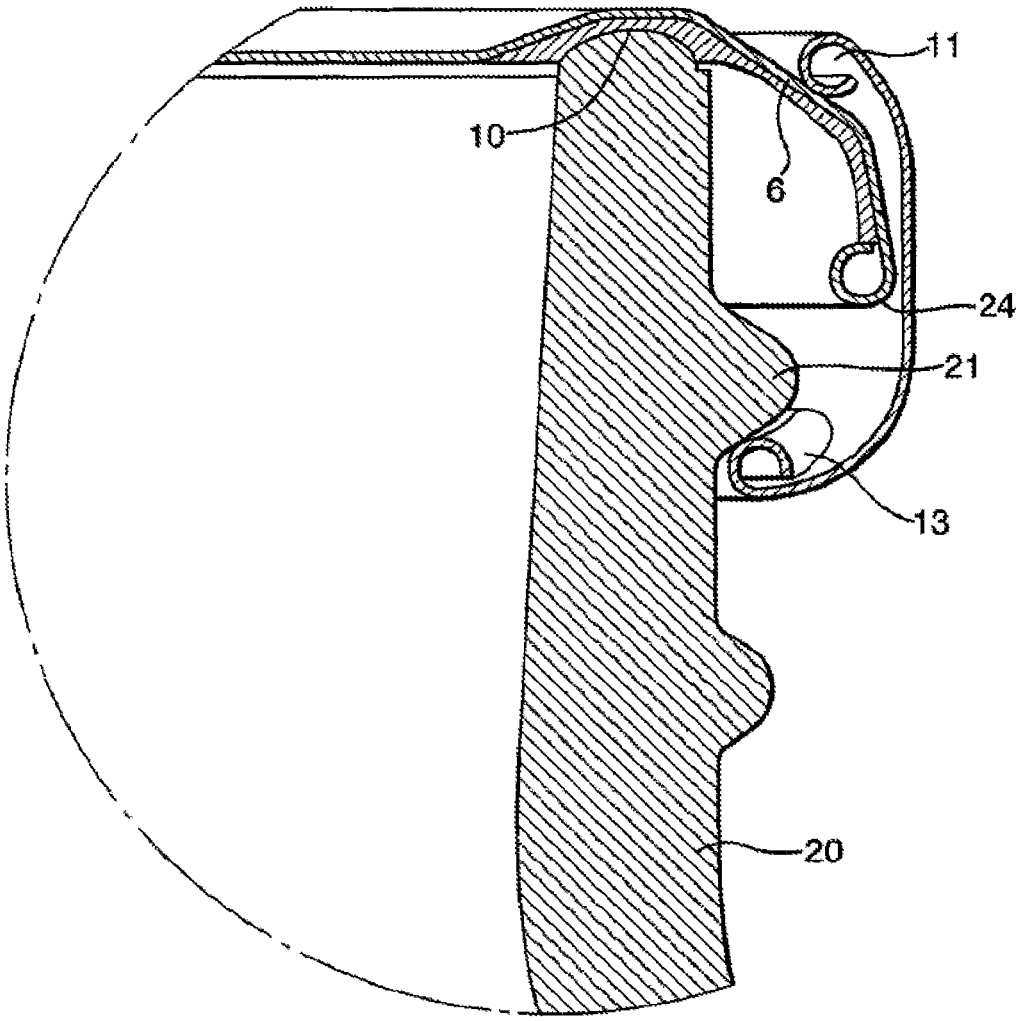
FIG. 8 is a partial side section through a lug of the closure of FIGS. 2 and 3 in closed position on a jar.

FIGS. 7 and 8 show the closure of FIGS. 2 and 3, closing a glass jar 20. When the closure is applied to a glass jar, the top of the jar presses into sealing material 9 forming an imprint and improved seal 10. The skirt (ring) is rotated and the lug 13 is moved under the thread 21 to pull the disc down.

The relative positions of improved seal 10, underside of disc rim 24 and inwardly projecting lug 13 can be seen in FIG. 8. The seal is defined by that part of the sealing material 9 imprinted by the jar 20.

In the closed position of FIGS. 7 and 8, shoulder 6 presses against upper curl 11 on the skirt, and lugs 13 press against the underside of threads 21. In the closed position of FIG. 8, the lug is under the thread of the glass jar, effectively pulling the disc into place and squeezing the sealing material.

Figure 9:
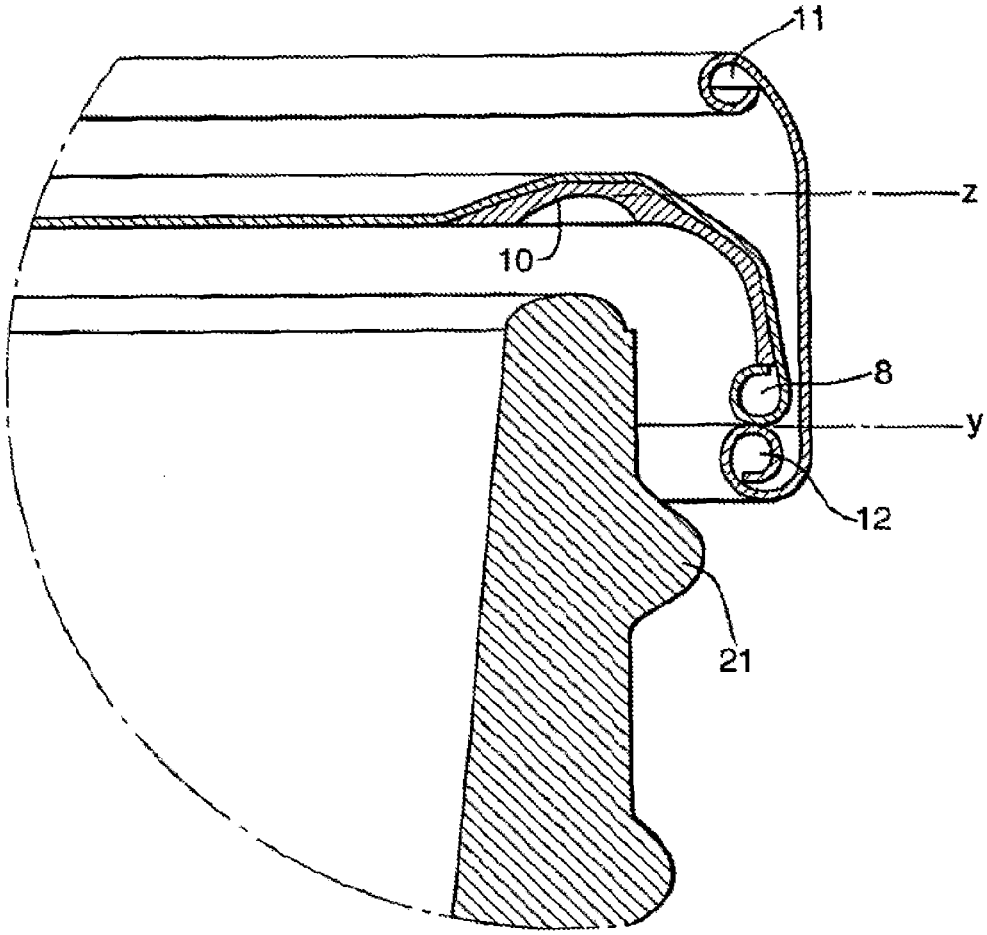
FIG. 9 is a partial side section through the curl of the closure of FIGS. 2 and 3, above a jar after opening.

Counter-rotation of the ring causes the lugs to move to positions above the adjacent threads and application of further torque causes lifting of the disc and full opening of the closure (see FIGS. 9 and 10). In the open position, the user has rotated the ring such that the lug 13 is now resting on top of the thread portion 21 (FIG. 10) and the adjacent portion of the bottom curl 12 has moved to contact the bottom of the disc curl 8 (FIG. 9). Moving the curls into contact with each other raises the disc, thereby breaking the seal.

In the final position of FIG. 10, a lug 13 contacts screw thread 21 at position 'X'. In FIG. 9, the contact point of curls 8 and 12 is shown as 'Y'. The effective lug thickness, which is the axial distance between X and Y, is distance 'A'. The axial (vertical) distance from the uppermost part 'Z' of compressed material (seal 10) to the bottom of disc curl 8 is 'B'. The distance from the glass finish (top of the container) to the top of thread 21 is 'C'.

In order for the seal to be broken, it is necessary for the sum of distances A+B to be greater than distance C. This invention is therefore not applicable to shallow cap-like closures.

An alternative version as shown in FIG. 11 has an outward curl 8'. FIG. 11 also shows how the sealing material 9 may be contained more locally by shaping the disc 2 into two parts: an upper annulus or horizontal portion 7*a* adjacent the shoulder 6 and a depending or vertical portion 7*b*, which terminates in an outward curl 8'. This is, of course an option which may be used in any of the other embodiments of the invention.

FIG. 11 shows the ring above the level of the top of groove 5 as it is in a "ring over disc" closure.

The embodiment of FIGS. 12 and 13, which is also of the "ring over disc" type, has a disc with inward curl 8, inclined shoulder 6 and single part annulus 7. The "ring over disc" closures have uppermost part of disc 3 lower than the top of the skirt, which may assist tightening of the skirt during closing. Over-tightening of the container may be avoided by flexing of the skirt in combination with the disc and at most the skirt will become level with the disc.

It is conventional to provide curls where an exposed edge of cut metal might otherwise be dangerous during handling, to obscure edges for cosmetic purposes, or to protect against corrosion.

Although the most preferred embodiments of closure shown in FIGS. 2 to 13 have all metal forms, it is clearly possible to have a metal disc and a plastic skirt. This enables the form shown in FIGS. 14*a* and 14*b* to be made more easily, although it could still be made from metal. FIG. 14*a* shows the skirt 3' alone. The top projection 11' is in four parts, with lugs 13 positioned below gaps between projections 11'. If the skirt 3' is made from plastic, the ejection of the skirt from the mould is easier, as is insertion of the metal disc 2 into the more flexible skirt.

Other features, which the closure may include, are flats or similar undulations 14 around the disc which form gaps 15 when inserted in skirt 3 (FIGS. 15 and 16). This provides a ventilation path and drying of the spaces between the skirt, disc and container is improved after filling.

Although the invention has predominantly been described with reference to an all-metal closure and a glass jar, the scope of the invention is also intended to include changes and modifications to materials etc and numbers of features such as lugs, as defined by the scope of the claims.

The invention claimed is:

1. A reclosable two-part closure configured to be removably fastened to a container having threads, the closure comprising: a metal disc and a metal skirt coupled to the metal disc, the metal disc having a seal and a surrounding rim and is held within the skirt moveably between an inwardly projecting rim at an upper end of the skirt and a lower skirt rim defined by either an annular inward projection on a wall of the skirt or lugs at a lower end of the skirt, wherein a sum of a first distance measured from the seal to a contact point of the disc rim and lower skirt rim along a first direction and an effective thickness of the annular inward projection or lugs measured along the first direction is greater than a second distance measured from the top of the threads on the container to a top of the container along the first direction, the first distance being greater than the effective thickness.

2. A closure according to claim 1, in which the upper end of the metal skirt is lower than a top of the metal disc.

3. A closure according to claim 1, in which the metal from which the metal disc is formed is a single piece of decorated metal.

4. A closure according to claim 1, in which the metal is steel having a thickness, which is less than that used for manufacturing vacuum twist closures of the same diameter.

5. A closure according to claim 1, in which the inwardly projecting rim on the top of the metal skirt includes a first inward curl and the lower end of the metal skirt includes a second inward curl.

6. A closure according to claim 5, in which the rim of the metal disc is curled inwardly.

7. A closure according to claim 5, in which the first and second inward curls have a radius of curvature of no less than 0.4 mm.

8. A closure according to claim 1, in which the inwardly projecting rim on the upper end of the metal skirt is discontinuous, so that inwardly projecting rim portions are only provided where there is no lug opposite.

9. A closure according to claim 1, in which the upper end of the metal skirt is higher than a top of the metal disc.

10. A closure according to claim 5, in which the rim of the metal disc is curled outwardly.

11. A closure according to claim 5, in which the rim of the metal disc includes sealing material.

12. A reclosable closure adapted for use with a container having a neck that defines both a top finish and a container projection with a top surface configured to contact the closure at a contact point such that a first axial distance measured along a first direction from the contact point to the top finish is defined, the closure comprising:

a disc having an outer rim that defines a lower most point of the disc, and a seal disposed within the rim, the seal having a lower surface configured to compress against the top finish of the container, such that a second axial distance measured along the first direction from the lower most point of the disc to an upper most point of the lower surface of the seal is defined; and a skirt coupled to the disc, the skirt having:

a wall with a top end and an opposing bottom end;

a first inward projection at the top end of the wall; and at least two lugs or inward projections at the bottom end of the wall, the at least two lugs or inward projections each having a height that defines a third axial distance along the first direction;

wherein the first axial distance is less than a sum of the second axial distance and the third axial distance.

13. The reclosable closure of claim 12, wherein, when the seal is compressed against the top finish of the container, the upper most point of the lower surface of the seal is defined, and the second axial distance is measured from the lower most point of the disc to the upper most point of the lower surface of the seal.

14. The reclosable closure of claim 12, wherein the disc is moveably held between the first inward projection at the top end of the wall and the at least two lugs or inward projections at the bottom end of the wall.

15. The reclosable closure of claim 12, wherein the at least two lugs or inward projections are annular projections.

16. The reclosable closure of claim 12, wherein the first inward projection includes a first inward curl and the at least two lugs or inward projections includes a second inward curl.

17. A container and closure combination comprising:

a container that has a top finish and a container projection below the top finish and defining a top surface;

a reclosable closure configured to contact the top surface of the container projection at a contact point, such that a first axial distance measured along a first direction from the contact point to the top finish is defined;

a disc having an outer rim that defines a lower most point of the disc, and a seal disposed within the outer rim, the seal having a lower surface configured to compress against the top finish of the container, such that a second axial distance measured along the first direction from the lower most point of the disc to an upper most point of the lower surface of the seal after the seal has been compressed against the top finish; and a skirt coupled to the disc, the skirt having a wall with a top end and an opposing bottom end;

a first inward projection at the top end of the wall; and a second inward projection at the bottom end of the wall, the second inward projection having a height that defines a third axial distance along the first direction;

wherein the first axial distance is less than a sum of the second axial distance and the third axial distance and the second axial distance is greater than the third axial distance.

18. The container and closure combination of claim 17, wherein the disc is moveably held between the first inward projection at the top end of the wall and the second inward projection at the bottom end of the wall.

19. The container and closure combination of claim 17, wherein the container projection is one of a thread, wave, or cam.

20. The container and closure combination of claim 19, wherein the container projection is a thread.

21. The container and closure combination of claim 17, wherein the container is made of glass.

* * * * *